US006253939B1

(12) United States Patent
Wan et al.

(10) Patent No.: US 6,253,939 B1
(45) **Date of Patent: *Jul. 3, 2001**

(54) TAMPER-EVIDENT CLOSURE HAVING IMPROVED DRAINAGE

(75) Inventors: Min Miles Wan, Plainfield; Manuel J. Mueller, Buffalo Grove; Valentin Hierzer, Arlington Heights; Donald Deubel, New Lenox, all of IL (US)

(73) Assignee: Crown Cork & Seal Technologies Corporation, Alsip, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/224,962

(22) Filed: Jan. 4, 1999

(51) Int. Cl.[7] ..... B65D 41/32; B65D 50/00

(52) U.S. Cl. ..... 215/252; 215/253; 215/258; 215/901

(58) Field of Search ..... 215/252, 253, 215/258, 217, 223, 250, 307, 329, 330, 210, 256, 901; 220/265, 266, 268

(56) References Cited

U.S. PATENT DOCUMENTS

| | | | |
|---|---|---|---|
| 3,968,823 | 7/1976 | Simon . | |
| 4,156,490 | 5/1979 | Peraboni . | |
| 4,196,818 | 4/1980 | Brownbill . | |
| 4,299,328 | 11/1981 | Ochs et al. . | |
| 4,305,516 | 12/1981 | Perne et al. . | |
| 4,394,918 | 7/1983 | Grussen . | |
| 4,418,828 | 12/1983 | Wilde et al. . | |
| 4,432,461 | 2/1984 | Mumford et al. . | |
| 4,458,822 | 7/1984 | Ostrowsky . | |
| 4,478,343 | 10/1984 | Ostrowsky . | |
| 4,506,795 | 3/1985 | Herr . | |
| 4,511,054 | 4/1985 | Shank . | |
| 4,526,282 | 7/1985 | Dutt et al. . | |
| 4,545,496 | 10/1985 | Wilde et al. . | |
| 4,546,892 | 10/1985 | Couput . | |
| 4,550,844 | 11/1985 | Lininger . | |
| 4,572,388 * | 2/1986 | Luker et al. | 215/252 |
| 4,592,475 | 6/1986 | Hannon et al. . | |
| 4,595,110 | 6/1986 | Herr . | |

(List continued on next page.)

FOREIGN PATENT DOCUMENTS

| | | |
|---|---|---|
| 0 593 396 A1 | 4/1994 | (EP) . |
| 0 616 951 A1 | 9/1994 | (EP) . |
| 0 801 005 A1 | 10/1997 | (EP) . |
| 2 033 350 | 5/1980 | (GB) . |
| WO 94/14673 | 7/1994 | (WO) . |
| WO 96/11856 | 4/1996 | (WO) . |

*Primary Examiner*—Allan N. Shoap
*Assistant Examiner*—Niki M. Eloshway
(74) *Attorney, Agent, or Firm*—Woodcock Washburn Kurtz Mackiewicz & Norris LLP

(57) ABSTRACT

A closure having a tamper-evident band secured to a container neck by a retaining band. The tamper-evident band is attached to the retaining band by a hinge so that the retaining band rotates upward about the hinge when the closure is applied to the neck of a container, causing the inner wall of the retaining band and the inner wall of the tamper-evident band to form a cavity therebetween. A number of rectangular openings are spaced around the circumference of the retaining band. The upper edge of each opening extends beyond the hinge and into the tamper-evident band. A recess in the inner wall of the tamper-evident band is located above each opening so that the lower edge of the recess intersects with the rear wall of the opening. The openings and recesses cooperate to ensure that any liquid that spills or splashes from the container neck into the cavity during capping will drain out.

10 Claims, 5 Drawing Sheets

U.S. PATENT DOCUMENTS 4,613,052 9/1986 Gregory et al. .
4,643,321 2/1987 Gach .
4,657,153 4/1987 Hayes .
4,666,053 5/1987 Corcoran et al. .
4,691,501 9/1987 King .
4,694,969 9/1987 Granat .
4,732,289 3/1988 Granat et al. .
4,796,770 1/1989 Begley .
4,801,030 1/1989 Barriac .
4,805,792 2/1989 Lecinski, Jr. .
4,807,771 2/1989 Roy et al. .
4,813,561 3/1989 Ochs .
4,813,562 3/1989 Begley .
4,846,361 7/1989 Haffner .
4,848,614 7/1989 Csaszar .
4,875,594 * 10/1989 Ochs ..... 215/252
4,895,266 1/1990 Begley .
4,971,212 11/1990 Kusz .
4,978,016 12/1990 Hayes .
4,981,230 1/1991 Marshall et al. .
5,054,268 10/1991 Hayes et al. .
5,058,755 10/1991 Hayes .
5,062,538 * 11/1991 Ochs ..... 215/252 X
5,080,246 1/1992 Hayes .
5,090,788 2/1992 Ingram et al. .
5,356,019 10/1994 Kelly .
5,400,913 3/1995 Kelly .
5,443,171 8/1995 Sprowl .
5,488,888 2/1996 Kowal .
5,660,290 * 8/1997 Hayes ..... 215/252
5,727,705 3/1998 Kelly .
5,755,347 5/1998 Ingram .

* cited by examiner

TAMPER-EVIDENT CLOSURE HAVING IMPROVED DRAINAGE

FIELD OF THE INVENTION

The current invention is directed to closure caps of the type that are used to seal containers and that have releasable tamper-evident bands. More specifically, the current invention is directed to such a cap having improved drainage capability.

BACKGROUND OF THE INVENTION

Conventionally, tamper-evident closures for containers comprise a threaded cap from which an annular skirt depends. A first band is releasable attached to the skirt by means of tear strips. A second band, sometimes referred to as a "fish hook," is attached to the first band by means of a flexible hinge. When the closure is inserted down over the container neck during initial installation by the bottler, the second band rotates upward so that its edge becomes located below, and faces, an annular bead formed on the container neck. This displacement of the second band causes a V-shaped cavity to be formed between the first and second bands. Such a closure is disclosed in U.S. Pat. No. 4,657,153 (Hayes), hereby incorporated by reference in its entirety.

When the closure is rotated upon removal, the entire assembly initially travels upward under the action of the threads until the edge of the second band engages the container annular bead. As a result of this engagement, the first band is prevented from further upward movement. Thereafter, continued rotation of the closure causes the tear strips to fracture, separating the cap from the first band, thereby providing a positive indication that the integrity of the closure has been compromised.

During capping, liquid sometimes spills or splashes over the lip of the container neck and drips down into the V-shaped cavity formed between the first and second bands. Over time, such liquid acts as a medium that can support the growth of undesirable bacteria and fungus. Although closures having openings in the second band have been used in the past, such openings are inadequately to allow complete drainage of the V-shaped cavity.

Consequently, it would be desirable to provide a tamper-evident closure with improved drainage capability.

SUMMARY OF THE INVENTION

It is an object of the current invention to provide a tamper-evident closure with improved drainage capability. This and other objects is accomplished in a tamper-indicating closure for sealing a container having a neck portion. The closure comprises (i) a cap portion adapted to engage the container neck and forming a downwardly extending annular skirt, (ii) a downwardly extending first band that forms an approximately circular inner wall, (iii) tear strips for releasably attaching the first band to the annular skirt, (iv) a second band having an inner wall and upper and lower edges, and (v) a hinge connecting the upper edge of the second band to the first band and that allows the second band to rotate upwardly toward the first band inner wall when the closure is applied to the container neck so as to form a cavity between the inner walls of the first and second bands. A plurality of openings are formed in the second band and spaced therearound. A plurality of recesses are formed in the inner wall of the first band and spaced therearound. The recesses in the first band inner wall and the openings in the second band cooperate to ensure that fluid drains from the cavity.

In a preferred embodiment of the invention, the openings in the second band extend through the hinge and into the inner wall of the first band. Moreover, at least one of the recesses is vertically aligned with each of the openings so that each of the openings is in flow communication with one of the recesses.

DESCRIPTION OF THE PREFERRED EMBODIMENT

Figure 1:
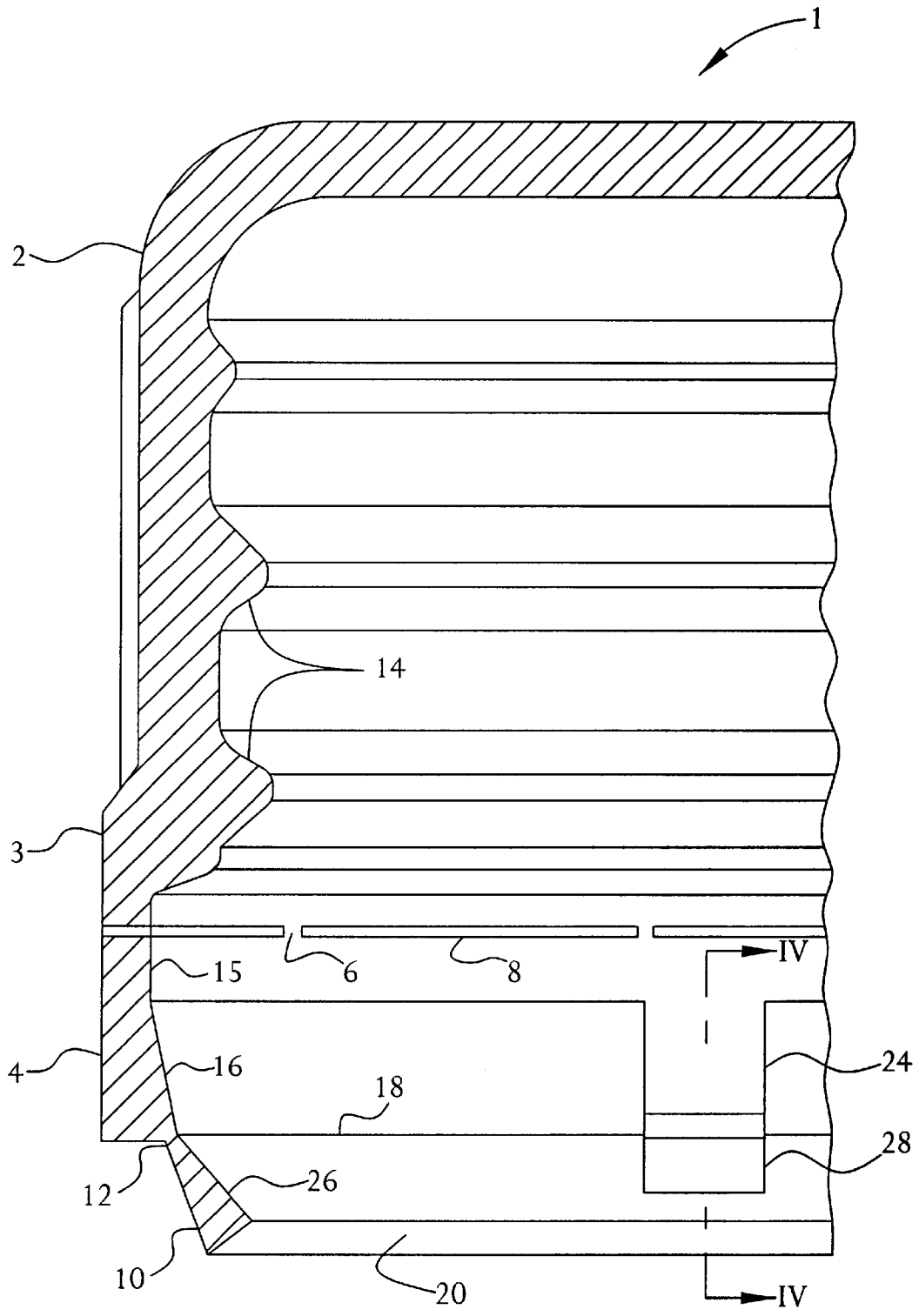
FIG. 1 is a portion of a longitudinal cross-section through a closure according to the current invention.
Figure 2:
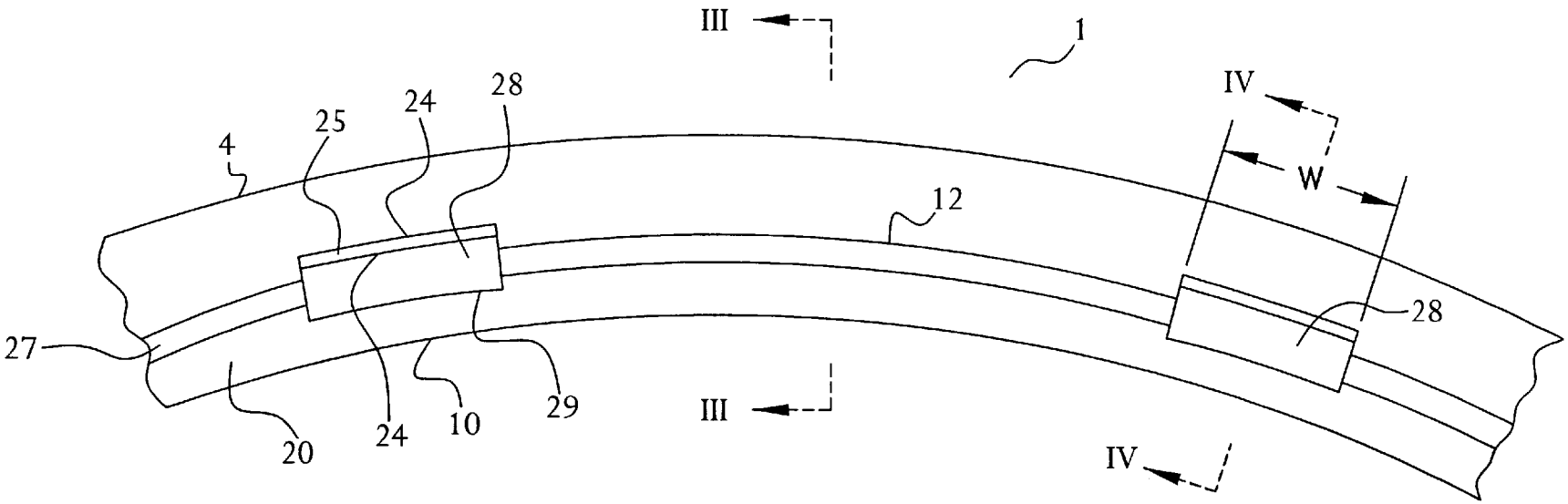
FIG. 2 is a bottom view of the closure shown in FIG. 1.

A tamper-evident closure 1 according to the current invention is shown in FIGS. 1–5. Preferably, the closure 1 is molded from a plastic. As is conventional, the closure 1 is comprised of a cap 2, a tamper-evident band 4, and a retaining band 10. The cap 2 features threads 14 that mate with threads 17 formed on the container neck 40, as shown in FIG. 6. The lower portion of the cap 2 forms a downwardly extending annular skirt 3.

The tamper-evident band 4 is connected to the skirt 3 by a number of tear strips 6 bridging a slit 8 that otherwise extends circumferentially around the closure 1. The upper portion of the tamper-evident band 4 forms an inner wall 15 that is preferably oriented approximately vertically. The lower portion of the tamper-evident band 4 forms an inner wall 16 that is preferably inclined at an angle A to the vertical direction, as shown best in FIG. 3, so that the base of the tamper-evident band is thicker than its top.

The retaining band 10 is connected to the tamper-evident band 4 by a hinge 12, formed by a thinned section of material at the interface between the bands. The retaining band 10 forms inner and outer walls 26 and 27, respectively. In the as-molded condition, the inner wall 26 is preferably inclined at an angle B, shown in FIG. 3, of about 50° with respect to the horizontal. The outer wall 27 is preferably inclined at a steeper angle so that the retaining band 10 is thick at its lower edge 20 that it is at its upper edge 19.

Figure 4:
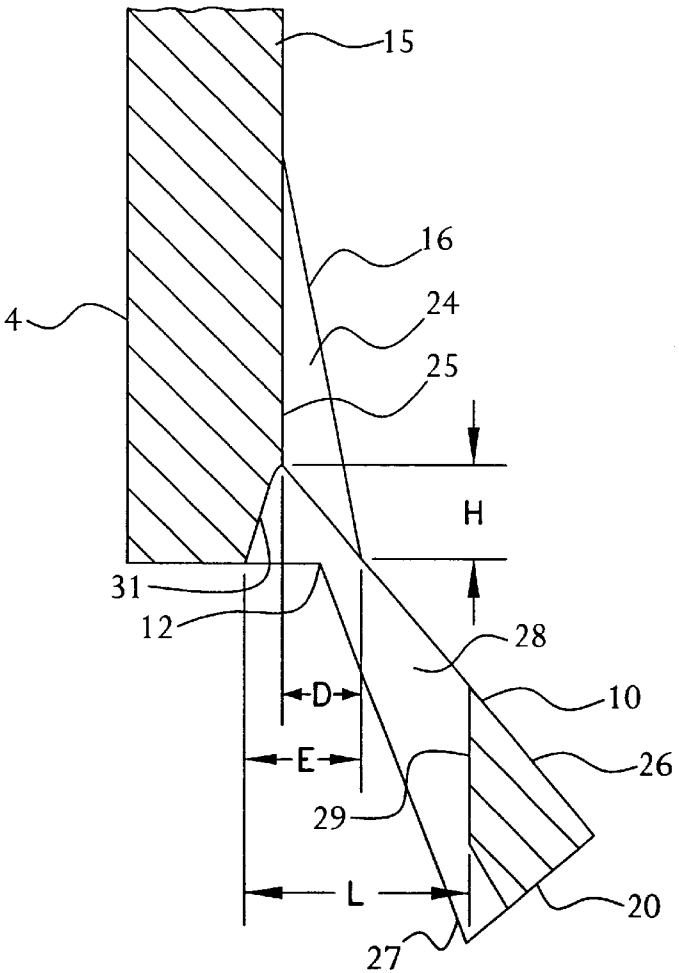
FIG. 4 is a cross-section similar to FIG. 3 except taken along line IV—IV shown in FIGS. 1 and 2.
Figure 3:
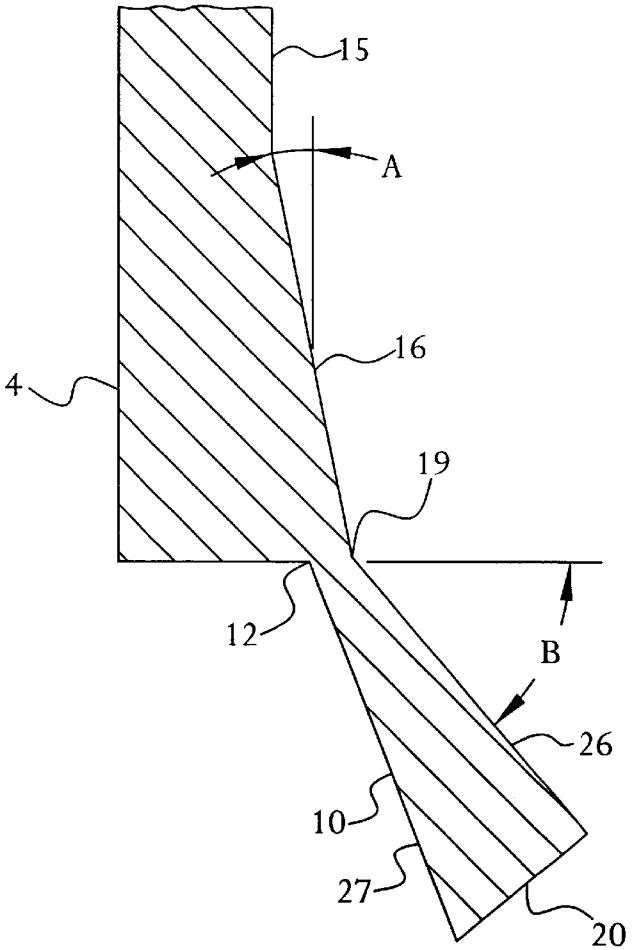
FIG. 3 is a cross-section of the closure shown in FIG. 1 taken through line III—III shown in FIG. 2.
Figure 5:
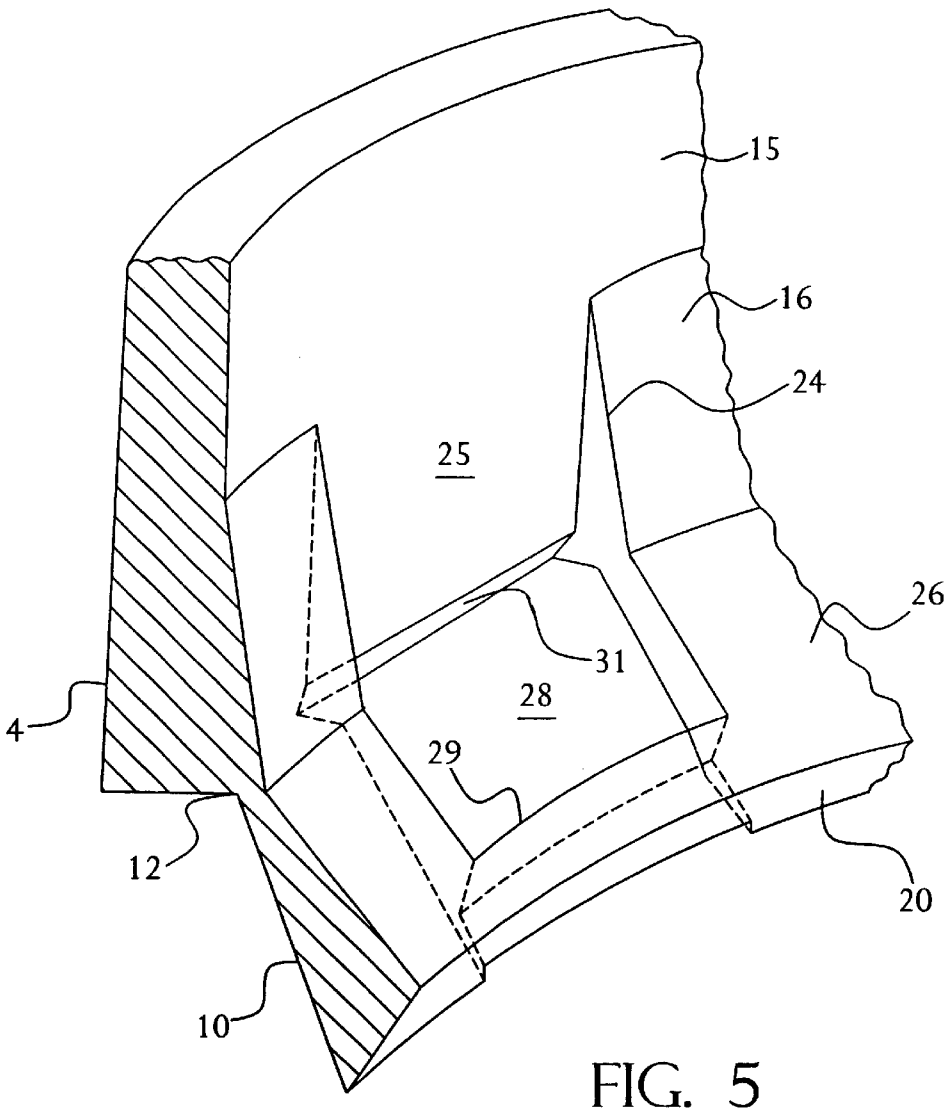
FIG. 5 is an isometric view of a cross-section through the tamper-evident band portion of the current invention.
Figure 6:
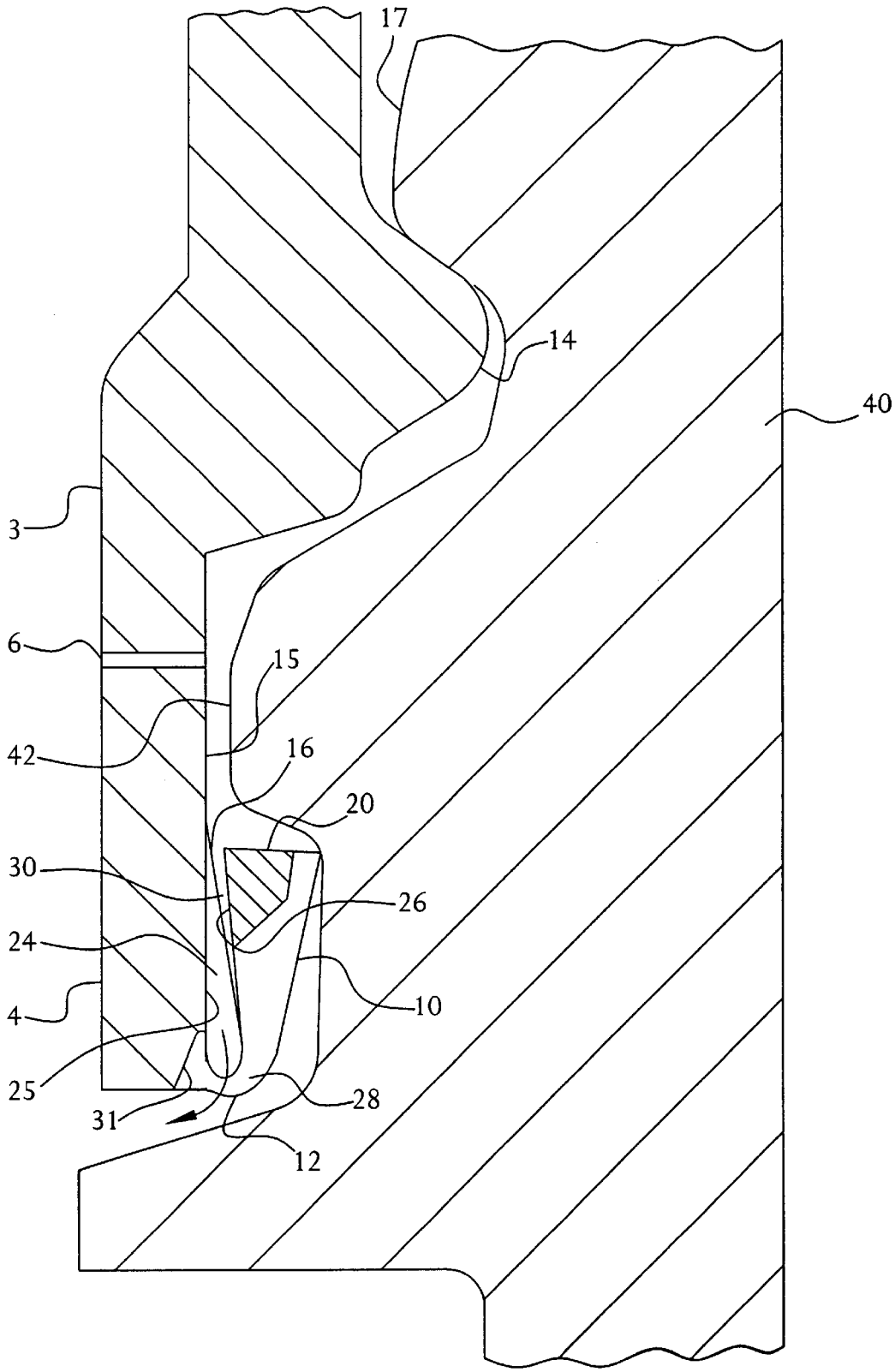
FIG. 6 is a longitudinal cross-section through the lower portion of the closure shown in FIG. 1 after it has been inserted over the neck of a container.

According to an important aspect of the current invention, a series of openings 28, shown best in FIGS. 4 and 5, are spaced around the circumference of the retaining band 10. Preferably, about six to twelve openings 28 are utilized and they are equally spaced around the circumference of the retaining band 10. The openings 28, which are preferably rectangular, preferably have a length L, measure in the horizontal direction when the retaining band 10 is in its as-molded condition as shown in FIG. 4, of at least approximately 0.04 inch and a width W, shown in FIG. 2, of at least approximately 0.08 inch. In the preferred embodiment, the openings 28 extend beyond the retaining band 10, through the hinge area 12, and into the recesses 14 formed in the tamper-evident band 4. Preferably, the openings 28 extend beyond the rear walls 25 of the recesses 24 so as to extend deeper into the tamper-evident band 4. Most preferably, the openings 28 extend a distance E, shown in FIG. 4, beyond the base of the tamper-evident band inner wall 16 that is at least about 0.02 inch. The vertical height H of the portion of each opening 28 that extends into the tamper-evident band 4 is preferably at least approximately 0.02 inch.

The upper wall 31 of each opening 28 is formed within the tamper-evident band 4 and disposed at an angle to the vertical direction. The lower wall 29 of each opening 28 is preferably oriented vertically in the as-molded condition. The thickness of the portion of the retaining band 10 below the lower wall 29 is preferably reduced, as shown best in FIG. 4, for ease of molding.

According to another important aspect of the current invention, a series of recesses 24 are formed in the lower inner wall 16 of the tamper-evident band 4. Each recess forms a rear wall 25 that preferably is aligned with the upper inner wall 15 of the tamper-evident band 4 so that the recess rear wall is oriented approximately vertically. Preferably, each opening 28 has one of the recesses 24 vertically aligned above it so that the lower edge of the recess rear wall 25 intersects with the rear wall 31 of the opening 28, as shown best in FIG. 4. Thus, each opening 28 is connected to, and in flow communication with, at least one recess 24. However, in some instances, it may be preferable to form additional recesses 24 in the inner wall 16 between openings 28. For example, six openings 28 and twelve recesses 24 may be utilized.

The width of each recess 24 is preferably the same as that of its opening 28. The maximum depth D of each recess 24, as shown in FIG. 4, is at least approximately 0.015 inch.

Referring to FIG. 6, when, upon capping, the closure 1 is inserted over the neck 40 of a container, the hinge 12 allows the retaining band 10 to rotate upwardly so that its lower edge 20 is located below an annular bead 42 the projects outwardly from the container neck. As is conventional, when the cap 2 is rotated upon removal, the entire closure assembly 1 initially travels upward as a unit under the action of the threads 14 and 17 until the lower edge 20 of the retaining band 10 engages the annular bead 42. This engagement prevents the tamper-evident band 4 from further upward travel. Thereafter, continued rotation of the cap 2 causes the tear strips 6 to fracture, providing a positive indication that the integrity of the closure 1 has been compromised. The fracture of the tear strips 6 allows the cap 2 to separate from the tamper-evident band 4 so that although the cap is removed, the tamper-evident band is left behind and remains attached to the container neck 40.

As also shown in FIG. 6, when the closure 1 is applied to the container neck 40, an approximately V-shaped cavity 30 is formed between the inner wall 16 of the tamper-evident band 4 and the inner wall 26 of the retaining band 10. As previously discussed, liquid can spill or splash over the container neck 40 and run down the threads into the V-shaped cavity 30 during capping.

According to the current invention, positive drainage of this fluid, as indicated by the arrow in FIG. 6, is assured by the cooperation of the openings 28 and the recesses 24. Specifically, unlike prior closures, the rear wall 31 of opening 28 extends beyond the hinge 12 area and into the tamper-evident band 4. This feature, in conjunction with the recess 24, ensures that the deflection of the retaining band 4 when rotated into its operative position on the container neck will not create a reservoir for fluid build-up. Fluid in the cavity 30 can readily flow along the rear walls 25 and through the recesses 24 and out through the openings 28.

In addition to facilitating drainage, the recess 24 ensure that the cavity 30 will be well vented so that any fluid droplets that remain in the cavity 30 will rapidly dry up.

The present invention may be embodied in other specific forms without departing from the spirit or essential attributes thereof and, accordingly, reference should be made to the appended claims, rather than to the foregoing specification, as indicating the scope of the invention.

What is claimed:

1. A tamper-indicating closure for sealing a container having a neck portion, said closure comprising:

a) a cap portion adapted to engage said container neck and forming a downwardly extending annular skirt;

b) a downwardly extending first band, said first band having an approximately circular inner wall having upper and lower portions, said lower portion of said inner wall forming a surface;

c) means for releasably attaching said first band to said annular skirt;

d) a second band having an inner wall;

e) a hinge connecting said second band to said first band, said hinge allowing said second band to rotate upwardly toward said first band inner wall when said closure is applied to said container neck so as to form a cavity between said inner walls of said first and second bands;

f) means for draining fluid from said cavity, said fluid drainage means comprising (i) a plurality of recesses formed in said lower portion of said inner wall of said first band and spaced therearound, each of said recesses extending radially outward beyond said surface formed by said lower portion of said first band inner wall, and (ii) a plurality of openings formed in said second band, each of said openings vertically aligned with one of said recesses in said first band and connecting therewith, whereby said recesses and said openings cooperate to drain fluid from said cavity.

2. The closure according to claim 1, each of said recesses form a first rear wall disposed in said first band, and wherein each of said openings forms a second rear wall disposed in said first band, each of said rear walls of said openings intersecting with one of said rear walls of said recesses, whereby each of said openings is in flow communication with one of said recesses.

3. The closure according to claim 1, wherein the number of said recesses is greater than the number of said openings.

4. The closure according to claim 1, wherein at least a portion of said inner wall of said first band is inclined at an angle to the vertical direction, each of said recesses being formed in said inclined portion of said first band inner wall.

5. The closure according to claim 4, wherein each of said recesses forms a rear wall, said recess rear walls extending substantially vertically.

6. The closure according to claim 1, wherein said releasable attaching means comprises a plurality of tear strips bridging said annular skirt and said first band.

7. The closure according to claim 1, wherein each of said recesses in said surface of said first band forms an approximately vertically extending recess wall, each of said openings extending radially outward beyond its respective recess wall.

8. The closure according to claim 7, wherein each of said openings forms an opening wall in said first band, said opening wall intersecting said recess wall of its respective recess.

9. The closure according to claim 8, wherein said opening wall is disposed at an angle to the vertical direction.

10. The closure according to claim 1, wherein said second band has an upper edge, and wherein each of said openings extend beyond said upper edge of said second band and through said hinge and penetrate into said lower portion of said first band inner wall so as to extend radially outward beyond said surface formed by said lower portion of said first band inner wall.

* * * * *

UNITED STATES PATENT AND TRADEMARK OFFICE

CERTIFICATE OF CORRECTION

PATENT NO. : 6,253,939 B1
DATED : July 3, 2001
INVENTOR(S) : Wan et al.

It is certified that error appears in the above-identified patent and that said Letters Patent is hereby corrected as shown below:

Title page,
Please include the following references which were omitted from the patent.

-- [56] References Cited

U.S. PATENT DOCUMENTS

| | | |
|---|---|---|
| 5,007,545 | 4/16/91 Imbery Jr. | |

FOREIGN PATENT DOCUMENTS

| | | |
|---|---|---|
| 0 447 021 A2 | 9/18/91 | EPO |
| WO 92 03348 | 3/5/92 | PCT |
| 0 560 051 A1 | 9/15/93 | EPO -- |

Signed and Sealed this

Twenty-second Day of October, 2002

*Attest:*

*Attesting Officer*

JAMES E. ROGAN
*Director of the United States Patent and Trademark Office*